US006566615B2

(12) United States Patent
Takeda

(10) Patent No.: US 6,566,615 B2
(45) Date of Patent: May 20, 2003

(54) INTERLOCKING TYPE MULTI-PUSH-SWITCH DEVICE

(75) Inventor: Masayuki Takeda, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/981,522

(22) Filed: Oct. 16, 2001

(65) Prior Publication Data

US 2002/0046933 A1 Apr. 25, 2002

(30) Foreign Application Priority Data

Oct. 24, 2000 (JP) ..... 2000-329797

(51) Int. Cl.[7] ..... H01H 9/26

(52) U.S. Cl. ..... 200/5 B; 200/5 E; 200/50.33; 200/50.36

(58) Field of Search ..... 200/5 B, 5 E, 200/5 EA, 5 EB, 18, 50.32, 50.33, 50.36, 520, 292, 239–243, 523, 524

(56) References Cited

U.S. PATENT DOCUMENTS 4,392,029 A * 7/1983 Schaad et al. ..... 200/5 B
4,575,590 A * 3/1986 Hattori et al. ..... 200/5 B
4,792,649 A * 12/1988 Wada ..... 200/5 E
5,808,248 A 9/1998 Aimi et al. ..... 200/16 R
5,932,854 A * 8/1999 Umemura ..... 200/5 B

* cited by examiner

*Primary Examiner*—Michael Friedhofer
(74) *Attorney, Agent, or Firm*—Beyer Weaver & Thomas, LLP

(57) ABSTRACT

An interlocking type multi-switch device having plural push-buttons is disclosed wherein external connection terminals can be connected using a single connector and the reduction in switch size can be attained while ensuring a high contact reliability of contact portions. In a housing (1) having plural receptacle portions (1*b*) is formed a connecting groove (1*e*) for connecting together the receptacle portions (1*b*). Plural fixed contacts (3) disposed within the plural receptacle portions (1*b*) and connecting terminals (4) are integrally fixed to a single wafer (2) and are arranged side by side on one and same plane. The wafer (2) is brought into engagement with the connecting groove (1*e*) formed in the housing (1), thereby allowing the plural fixed contacts (3) to be disposed within the receptacle portions (1*b*).

5 Claims, 5 Drawing Sheets

INTERLOCKING TYPE MULTI-PUSH-SWITCH DEVICE

BACKGROUND OF THE INVENTION

1. Field of the Invention

The present invention relates to the structure of a circuit section in a multi-switch device to be used as a power switch for switching from one air volume to another in a ventilation fan for example.

2. Description of the Related Art

As a conventional power switch to be used for switching from one air volume to another in a ventilation fan for example there mainly is used a push-button switch of an interlocking type having plural push-buttons. By depressing these push-buttons selectively it is made possible to switch over among functions such as OFF (Reset) open (opening of flaps), Weak Wind, Medium Wind, and Strong Wind.

In such a conventional multi-push-button switch, an independent switch circuit section is formed for each push-button and external connection terminals are provided for each such switch circuit section. Further, connectors for wiring to a power supply and a ventilation fan are connected to the external connection terminals.

Such a conventional switch device is mainly composed of a housing which is formed generally in a box shape using an insulating material such as a synthetic resin and in which are formed plural receptacle portions, slide members disposed respectively in the receptacle portions vertically slidably, movable contacts formed of an electrically conductive metallic material and held by the slide members respectively, fixed contacts also formed of an electrically conductive metallic material and disposed in the receptacle portions respectively, the fixed contacts being put in sliding contact with and disengagement from the movable contacts to turn ON or OFF a circuit, return springs for restoring the slide members lying in depressed positions to initial positions respectively at the time of an interlocking operation, and interlocking cams for interlocking the slide members.

According to the construction of the above switch circuit section, the fixed contact disposed in each receptacle portion in the housing has a contact surface located in an ascending/descending direction of the associated slide member, the associated movable contact which comes into sliding contact with the fixed contact is held by the slide member so as to come into sliding contact with the contact surface of the fixed contact. That is, contact portions are put in sliding contact with each other in the ascending/descending direction of the slide member.

In the above structure of the conventional switch device, however, an independent switch circuit section is formed for each push-button, external connection terminals are provided for each switch circuit section, and connectors for wiring to a power supply and a ventilation fan are connected respectively to the external connection terminals. Thus, since connectors are needed for each switch circuit, there arises the problem that the working efficiency at installation is poor.

Moreover, in each of the above switch circuit sections, the contact surface of the fixed contact is disposed in the ascending/descending direction of the slide member, and the movable contact for sliding contact with the fixed contact is also formed in the ascending/descending direction of the slide member so as to come into sliding contact with the contact surface of the fixed contact, thus requiring a certain distance for the sliding contact in the operating (ascending/descending) direction of the slide member. As a result, the depth of the housing becomes large and hence there arises the problem that the reduction of size is difficult.

SUMMARY OF THE INVENTION

Accordingly, it is an object of the present invention to solve the above-mentioned problems and provide a structure of a multi-switch device of an interlocking type having plural push-buttons wherein external connection terminals of the switch device can be connected using a single connector and the reduction of switch size can be attained while ensuring a high contact reliability of contact portions.

For solving the above-mentioned problems, according to the first means adopted in the present invention there is provided a switch device comprising a housing having a plurality of receptacle portions; a plurality of fixed contacts disposed in the receptacle portions; a plurality of slide members which hold movable contacts, the movable contacts being adapted to move into contact with and away from the fixed contacts, and which are disposed vertically movably in the receptacle portions; and a plurality of connecting terminals drawn out from the from the fixed contacts and projected to the exterior of the housing, wherein a connecting groove for connecting together the plural receptacle portions is formed in the housing, the plural fixed contacts and connecting terminals are fixed integrally to a single wafer and are arranged on one and same plane, and the wafer is engaged with the connecting groove formed in the housing, thereby allowing the plural fixed contacts to be disposed within the receptacle portions.

According to the second means adopted in the present invention, the connecting groove formed in the housing is formed in a direction orthogonal to an ascending/descending direction of the slide members, the fixed contacts on the wafer engaged with the connecting groove are disposed on inside bottoms of the receptacle portions so that contact surfaces thereof lie in a direction orthogonal to the ascending/descending direction of the slide members, and the movable contacts and the fixed contacts are arranged in the ascending/descending direction of the slide members.

According to the third means adopted in the present invention, the slide members are each formed with a holding portion for holding the associated movable contact, and the movable contact is held in the holding portion in an obliquely inclined state with respect to the contact surface of the associated fixed contact.

According to the fourth means adopted in the present invention, the movable contacts are each formed with a convex projection and a chip-like contact portion both on the surface thereof opposed to the contact surface of the associated fixed contact, and while the associated slide member moves vertically, the convex projection first comes into abutment against the contact surface of the fixed contact and thereafter the chip-like contact portion comes into abutment against the contact surface of the fixed contact.

According to the fifth means adopted in the present invention, a spring member for urging the movable contact in a direction of abutment against the contact surface of the fixed contact is provided in the holding portion of each of the slide members, the spring member being constituted by a hand-drum-shaped coiled spring.

DETAILED DESCRIPTION OF A PREFERRED EMBODIMENT

Figure 1:
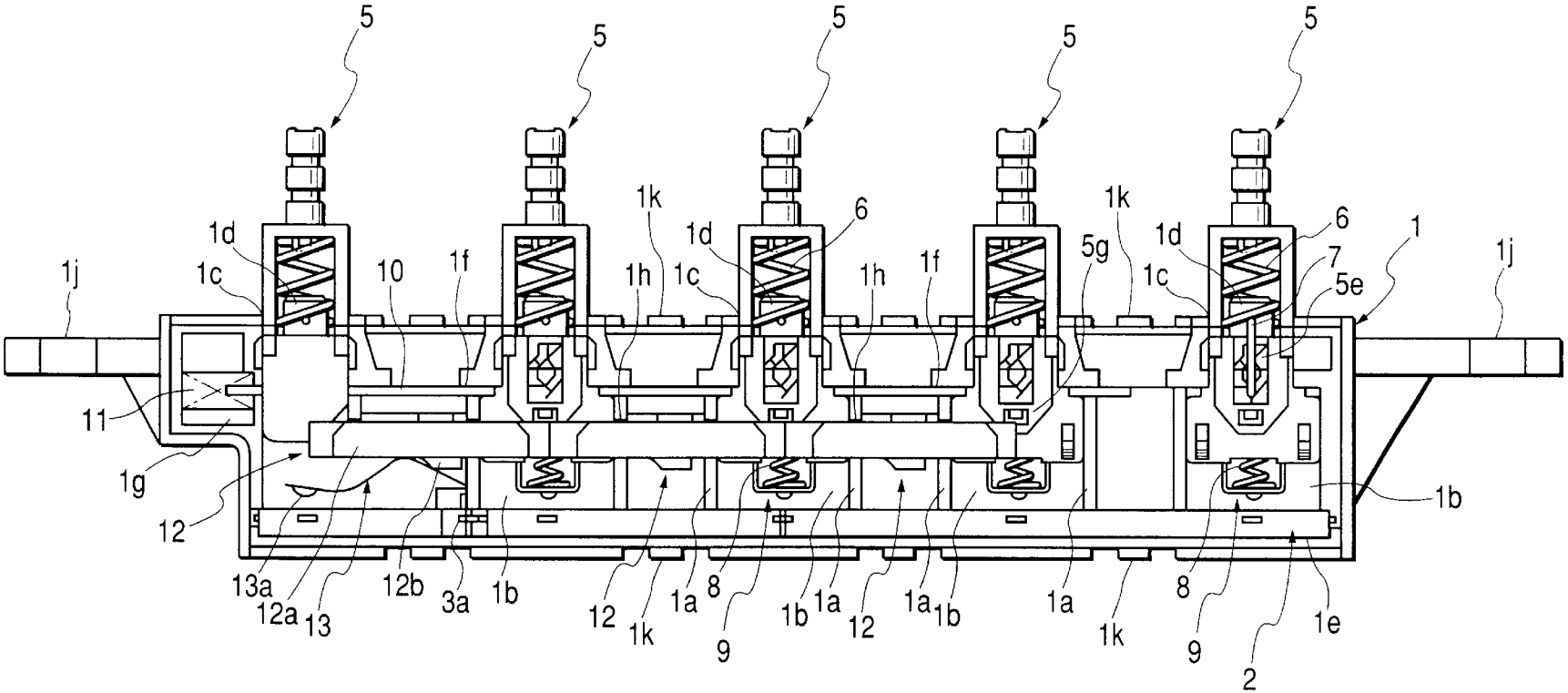
FIG. 1 is a front view of a switch device according to an embodiment of the present invention, with a cover removed.
Figure 2:
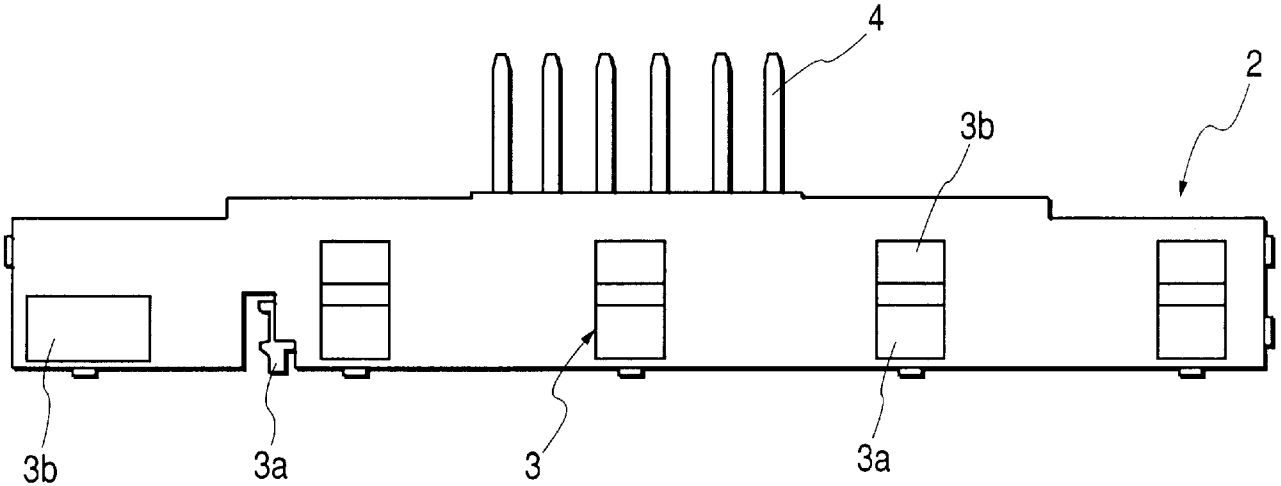
FIG. 2 is a plan view of a wafer used in the switch device.
Figure 3:
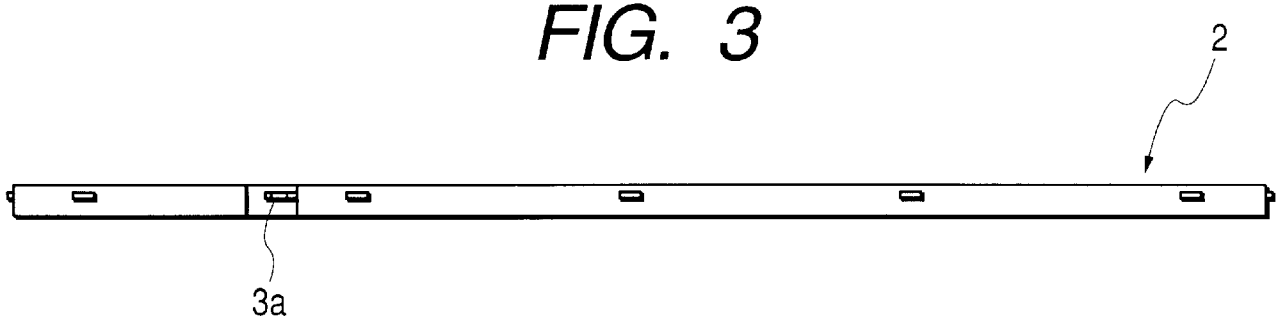
FIG. 3 is a front view thereof.
Figure 4:
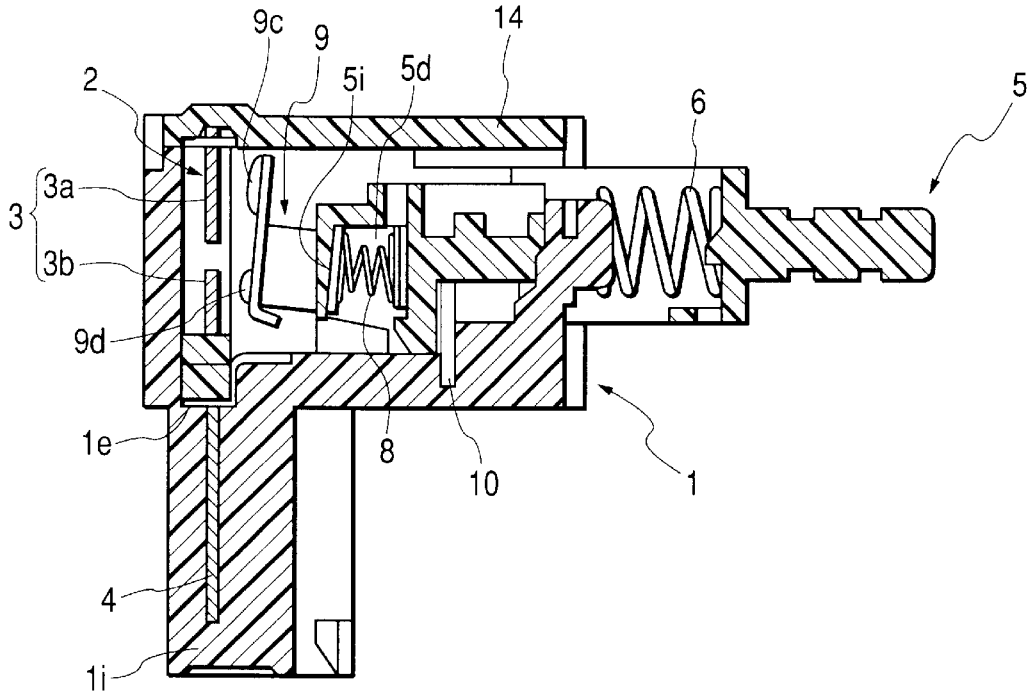
FIG. 4 is an explanatory diagram showing contact portions spaced apart from each other in an initial position of a slide member in the switch device.
Figure 5:
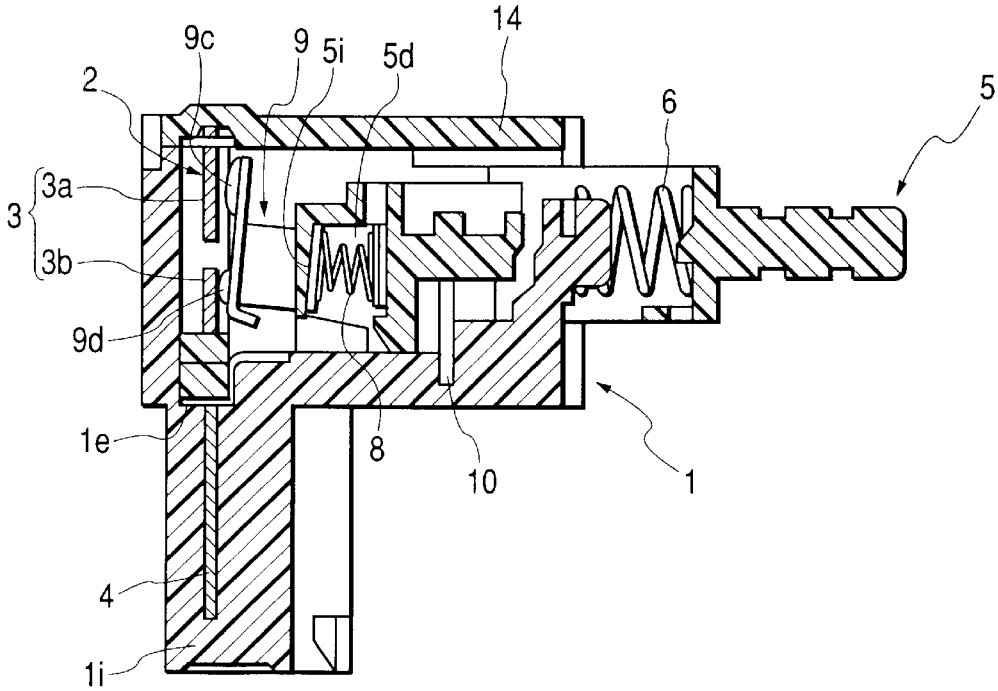
FIG. 5 is an explanatory diagram showing a state of the switch device in which the slide member is pushed and a protuberance of a movable contact is abutted against a fixed terminal.
Figure 6:
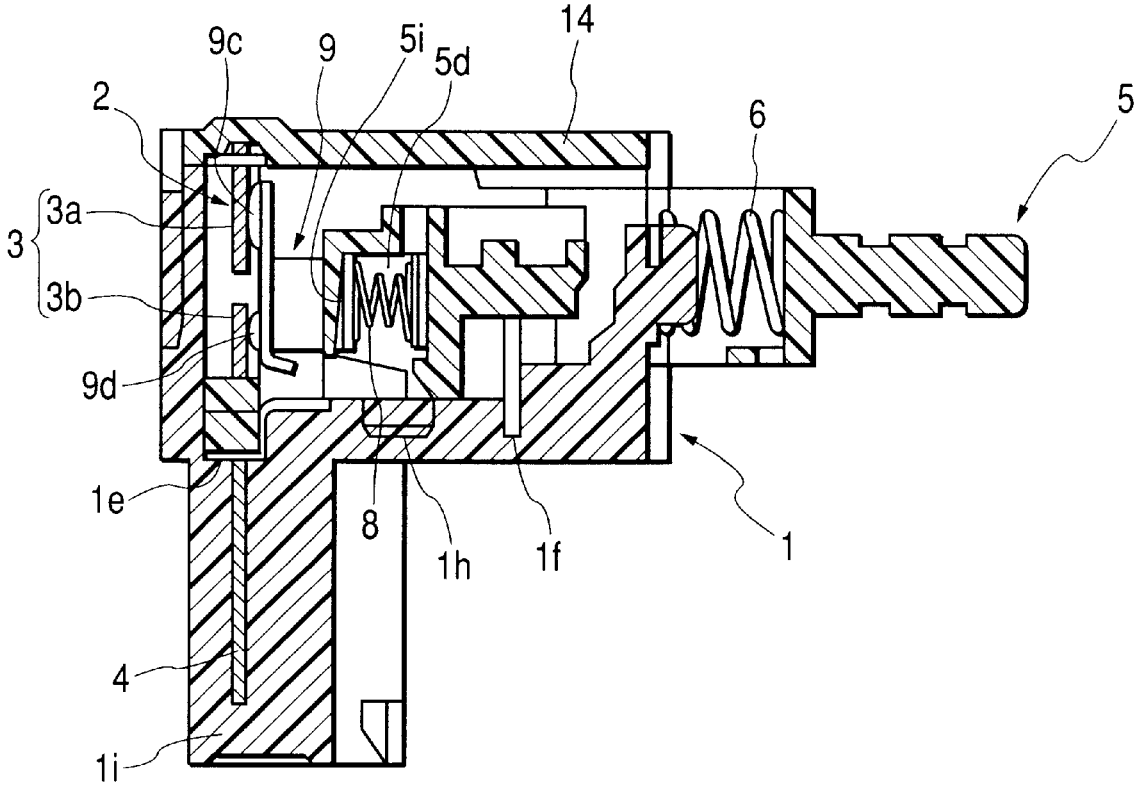
FIG. 6 is an explanatory diagram showing a state of the switch device in which the slide member is locked and a movable contact and a fixed contact are connected with each other.
Figure 7:
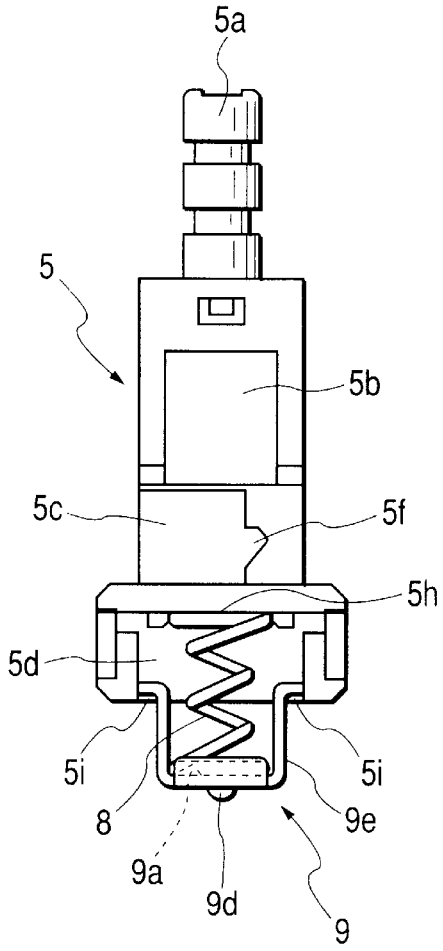
FIG. 7 is a front view showing a state of the switch device in which the movable contact is held by the slide member through a spring member.
Figure 8:
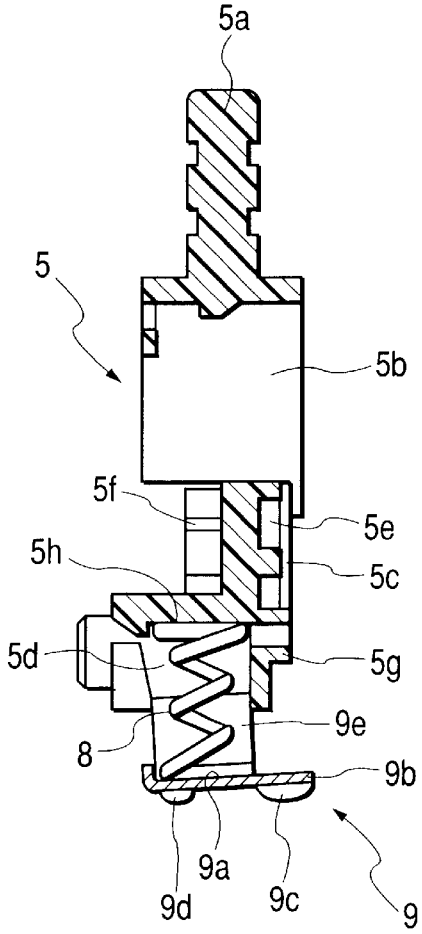
FIG. 8 is a sectional view thereof.

A switch device according to an embodiment of the present invention is illustrated in FIGS. 1 to 8. FIG. 1 is a front view of the switch device, with a cover removed, FIG. 2 is a plan view of a wafer, FIG. 3 is a front view thereof, FIG. 4 is an explanatory diagram showing a state in which contact portions are spaced apart from each other at an initial position of a slide member, FIG. 5 is an explanatory diagram showing a state in which the slide member is pushed and a projection of a movable contact is abutted against a fixed terminal, FIG. 6 is an explanatory diagram showing a state in which the slide member is locked and a movable contact and a fixed contact are connected with each other, FIG. 7 is a front view showing a state in which the movable contact is held by the slide member through a spring member, and FIG. 8 is a sectional view thereof.

In the drawings, a housing 1 is formed in the shape of a generally quadrangular box using an insulating material such as a synthetic resin. In the housing 1 are formed a plurality of receptacle portions 1*b* which are partitioned from one another with partition walls 1*a*. Slide members 5 to be described later are disposed respectively in the receptacle portions 1*b* in a slidable manner (for ascending and descending motion). On one end side of each receptacle portion 1*b* is formed an opening 1*c* for outward projection therethrough of the associated slide member 5. Centrally of the opening 1*c* is formed a return spring retaining portion 1*d* for retaining a return spring 6 which urges the slide member 5 to be described later to a home position thereof.

On the side opposite to the opening 1*c* is formed a rectilinear connecting groove 1*e* for connecting the receptacle portions 1*b* with one another. The connecting groove 1*e* is formed in inside bottoms of the receptacle portions 1*b*. A wafer 2, to which plural fixed contacts 3 to be described later are fixed, is brought into engagement with the connecting groove 1*e*, whereby the plural fixed contacts 3 are arranged within the receptacle portions 1*b*.

In the housing 1 are formed interlocking cam retaining grooves if and an interlocking spring retaining portion 1*g* for holding an interlocking cam 10 to be described later and an interlocking spring 11, respectively, which are for causing the slide members 5 to be described later to perform an interlocking operation. Further, simultaneous lock preventing cam retaining grooves 1*h* for preventing simultaneous locking of the slide members 5 are formed in the housing 1. The interlocking cam retaining grooves 1*h* and the simultaneous lock preventing cam retaining grooves 1*h* are formed in the partition walls 1*a*. The interlocking cam 10 and simultaneous lock preventing cams 12 are disposed within the receptacle portions 1*b* through the interlocking cam retaining grooves 1*f* and the simultaneous lock preventing cam retaining grooves 1*h*, respectively.

A quadrangularly projecting holder portion 1*i* for connection thereto of a connector for external connection is formed centrally of the back side of the housing 1. The holder portion 1*i* and the connecting groove 1*e* are interconnected within the housing 1 and connecting terminals 4 drawn out from plural fixed contacts 3 are projected into the holder portion 1*i*, the plural fixed contacts 3 being fixed to the wafer 2 to be described later which wafer 2 is engaged with the connecting groove 1*e*.

Mounting arms 1*j* are extended from both longitudinal ends of the housing 1. The switch device is mounted to a chassis or a mounting plate of another device by fixing the mounting arms 1*j* with screws or the like. Plural engaging lugs 1*k* are formed on upper and lower surfaces of the housing 1. A cover member 14 to be described later is brought into engagement with the engaging lugs 1*k* and is thereby mounted so as to cover the openings of the receptacle portions 1*b*.

The wafer 2 is formed in the shape of a generally quadrangular flat plate using an insulating material such as a synthetic resin. Inside the wafer 2 are formed plural fixed contacts 3 using an electrically conductive metallic plate integrally by insert molding for example. The fixed contacts 3 are arranged side by side on one and same plane in an exposed state of respective contact surfaces to the surface side of the wafer 2. The fixed contacts 3 are provided at plural positions in an opposed state of common contacts 3*a* which are electrically conducted in the interior of the wafer 2 and individual contacts 3*b* which are electrically isolated. Centrally and on one side face of the wafer 2, the connecting terminals 4 drawn out from the fixed contacts 3 are gathered nearly centrally and are projected onto one and same plane like the fixed contacts 3.

The wafer 2 is engaged with the connecting groove 1*e* formed in the housing 1, whereby the plural fixed contacts 3 are arranged within the receptacle portions 1*b*. The connecting groove 1*e* in the housing 1 is formed in a direction orthogonal to a sliding (ascending/descending) direction of the slide members 5 which will be described later. Therefore, contact surfaces of the fixed contacts 3 on the wafer 2 which is engaged with the connecting groove 1*e* are disposed on the inside bottoms of the receptacle portions 1*b* also in a direction orthogonal to the sliding (ascending/descending) direction of the slide members 5.

In this case, the plural fixed contacts 3 and connecting terminals 4 are fixed integrally to a single wafer 2 and are arranged side by side on one and same plane. The wafer 2 is brought into engagement with the connecting groove 1*e* formed in the housing 1, whereby the plural fixed contacts 3 are arranged within the receptacle portions 1*b* and the connecting terminals 4 are gathered centrally. Therefore, it suffices for only one connector to be attached to the connecting terminals 4 for wiring to a power supply and a ventilation fan. Thus, the working efficiency in the mounting work is improved.

Also as to the contact surfaces of the fixed contacts 3 on the wafer 2 which is engaged with the connecting groove 1*e*, they are disposed on the inside bottoms of the receptacle portions 1*b* in a direction orthogonal to the sliding (ascending/descending) direction of the slide members 5.

Therefore, movable contacts 9 to be described later and the fixed contacts 3 can be arranged in the ascending/descending direction of the slide members 5, whereby the depth of the housing 1 can be made small and hence the reduction in size of the switch device can be attained.

The slide members 5 are formed of an insulating material such as a synthetic resin and are slidably disposed in the receptacle portions 1*b* of the housing 1. Each slide member 5 is formed with an operating portion 5*a* projected from the associated opening 1*c* in the housing 1 and adapted to be pushed and a return spring receiving portion 5*b* for receiving the associated return spring 6 which urges the operating portion 5*a* in the projecting direction and which is constituted by a coiled spring like a winding. The slide member 5 is also formed with a cam-formed portion 5*c*, the cam-formed portion 5*c* performing predetermined operations in cooperation with the interlocking cam 10 to be described later in interlocking action and a single-acting pin 7 in single action and the associated simultaneous lock preventing cam 12, which will be described later, and is further formed with a movable contact holding portion 5*d* for holding the associated movable contact 9 to be described later.

On one side of the cam-formed portion 5*c* is formed a heart cam 5*e* for single action which has a heart-shaped cam groove, while on the side opposite to the heart cam 5*e* is formed a cam projection 5*f* for interlocking action. On a lower end side of the heart cam 5*e* is formed a delimiting lug 5*g* having a pair of opposed slant faces for abutment against the simultaneous lock preventing cam 12.

On a ceiling side of the movable contact holding portion 5*d* is formed a spring member retaining portion 5*h* for holding a spring member 8 which urges the associated movable contact 9 toward the associated fixed contact 3, which movable contact will be described later. On a bottom side of the movable contact holding portion 5*d* is formed a movable contact receiving portion 5*i* which is constituted by a slant face. The spring member 8 held by the movable contact holding portion 5*d* is constituted by a coiled spring like a winding and is formed in a hand-drum shape having a central portion smaller in diameter than anchored portions at both ends. Consequently, the movable contact 9 held in the movable contact holding portion 5*d* is held in an obliquely inclined state relative to the contact surface of the fixed contact 3 by the slant face of the movable contact receiving portion 5*i* and also by the hand-drum-like spring member 8.

The movable contact 9 is formed in a generally U-bent shape by an electrically conductive metallic plate. Centrally of the movable contact 9 is provided a spring member retaining portion 9*a* for retaining one end side of the spring member 8. On one end side of the spring member retaining portion 9*a* there projects a projecting piece 9*b* in parallel with the spring member retaining portion 9*a*. On the back side of the projecting piece 9*b* and the spring member retaining portion 9*a*, i.e., on the side opposed to the contact surface of the fixed contact 3, there are formed a chip-like contact portion 9*c* and a convex protuberance 9*d*. On both sides of the spring member retaining portion 9*a* are formed support piece 9*e* which are bent opposedly to each other. Upper ends of the support pieces 9*e* are held by the movable contact receiving portion 5*i*.

In this case, the movable contact 9 is held in an obliquely inclined state relative to the contact surface of the fixed contact 3 by the slant face of the movable contact receiving portion 5*i* and the hand-drum-like spring member 8. Therefore, in a sliding (ascending/descending) motion of the slide member 5, the protuberance 9*d* first comes into abutment against the contact surface of the individual contact 3*b* of the associated fixed contact 3 and thereafter the contact portion 9*c* comes into abutment against the contact surface of the common contact 3*a* of the fixed contact 3. In this connection, the spring member 8 used a hand-drum-shaped coiled spring, so even when the spring member retaining portions 5*h* and 9*a* tilt obliquely with respect to each other, the coiled spring is easy to bend with the hand-drum center of the coiled spring as fulcrum, thus facilitating a swing motion of the movable contact 9 and affording a stably contacted state.

In case of switching from one contact portion to another in the switch device, the chip-like contact portion 9*c* is sure to later abut the fixed contact 3, so an arc which forms at the time of switch-over is always applied to the same chip-like contact portion 9*c* and the protuberance 9*d* of the movable contact 9 which first comes into abutment against the fixed contact 3 does not undergo a so large electrical load and is little deteriorated. Therefore, it is not necessary to use an expensive chip-like contact portion formed by a noble metal for example and thus the cost of the switch contact portion can be reduced.

Further, the movable contact 9 is held in an obliquely inclined state relative to the contact surface of the fixed contact 3, so when the contact portion 9*c* or protuberance 9*d* of the movable contact 9 comes into contact with the contact surface of the fixed contact 3, the contact is a sliding contact with the contact surface, so there is attained a self-cleaning effect for the contact surface and the contact reliability of the contact portion is improved.

The interlocking cam 10 is formed in an elongated shape using a flat metallic plate such as a steel plate. The interlocking cam 10 is held in the interlocking cam retaining groove 1*f* in the housing 1 slidably in a direction orthogonal to sliding (ascending/descending) direction of the slide members 5. One end side of the interlocking cam 10 is urged with the interlocking spring 11 constituted by a winding-like coiled spring, so that plural cam portions (not shown) are pushed against and retained by the cam projections 5*f* of the slide members 5.

Each simultaneous lock preventing cam 12 is formed in an elongated, generally quadrangular shape using an insulating material such as a synthetic resin and is centrally formed with a trapezoidal delimiting portion 12*a*. It is disposed between adjacent slide members 5 described above. Each simultaneous lock preventing cam 12 is held in the associated simultaneous lock preventing cam retaining groove 1*h* in the housing 1 so as to be slidable in a direction orthogonal to the sliding (ascending/descending) direction of the slide members 5, and is urged by the delimiting lug 5*g* of the associated slide member 5 and is thereby made slidable in the right and left direction. On the underside of the simultaneous lock preventing cam 12 is formed an operating lug 12*b* which urges a conductor plate 13 to be described later.

The conductor plate 13 is formed by an electrically conductive metallic plate having resilience. One end side of the conductor plate 13 is connected constantly to the common contact 3*a* on the wafer 2 and a contact portion 13*a* fixed to a free end side of the conductor plate 13 is disposed within the associated receptacle portion 1*b* so as to confront the individual contact 3*b*. The conductor plate 13 is operated by the operating lug 12*b* with movement of the simultaneous lock preventing cam 12.

The cover member 14 is formed in the shape of a generally flat shape using an insulating material such as a synthetic resin. On both side portions of the cover member 14 are formed a plurality of hook portions (not shown) having engaging holes for engagement with the engaging lugs 1*k* formed on the housing 1. The cover member 14 is attached to the housing 1 so as to cover the openings 1*c* of the plural receptacle portions 1*b* formed in the housing 1.

Next, the operation of the switch device constructed as above will be described below.

In FIG. 1, one key located on the right end is a single-acting key, acting as a lamp switching key for illumination, three central keys are interlocking keys, acting as wind force switching keys for switching Strong, Medium, and Weak wind forces selectively, and one key located on the left end is a reset key for unlocking the interlocking keys.

First, in a single-acting operation, by pushing the operating portion 5*a* of the single-acting key, the single-acting pin 7 slides within the cam groove of the heart cam 5*e* and the slide member 5 is locked at its locking position. At this time, the movable contact 9 is connected with the fixed contact 3 to turn ON the circuit. For unlocking, the operating portion 5*a* is again pushed, whereby the heart cam 5*e* is unlocked and the slide member 5 returns to its initial position, so that the circuit is turned OFF.

Next, in an interlocking operation, when any one of the interlocking keys is pushed, the cam projection 5*f* formed on the associated slide member 5 pushes a cam portion of the interlocking cam 10, so that the interlocking cam 10 is caused to slide in a direction orthogonal to the pushing direction and is engaged with the cam projection 5*f* under the biasing force of the interlocking spring 11 and is locked thereby. At this time, the movable contact 9 is connected with the fixed contact 3 to turn ON the circuit. In this state, if another interlocking key is pushed for changing the wind force, the interlocking cam 10 is pushed and slides by the cam projection 5*f* of the slide member 5 in the pushed key, whereby the cam projection 5*f* of the slide member 5 which has locked the interlocking cam becomes unlocked to turn OFF the circuit. At this time, the pushed interlocking key is newly locked to turn ON the circuit.

In this case, the simultaneous lock preventing cams 12 are pushed and slide in the right and left direction by the delimiting lug 5*g* formed on the slide member 5 of the pushed interlocking key, whereby it is possible to prevent simultaneous locking (keeping two or more keys in a locked state simultaneously) of the other interlocking keys.

When an interlocking key is pushed for switching over from one wind force to another, the simultaneous lock preventing cam 12 is caused to slide and the operating lug 12*b* formed thereon pushes the conductor plate 13 disposed within the receptacle portion 1*b* in the housing to turn ON the circuit, whereby the flaps of the ventilation fan are opened.

Next, for resetting all of the interlocking keys, the reset key is pushed, whereby the interlocking cam 10 is pushed and slides by the cam projection 5*f* of the slide member 5 in the reset key, so that the cam projection 5*f* of the slide member 5 in the interlocking key which has locked is disengaged and unlocked to turn OFF the circuit. In this case, since the reset key is not provided with a cam projection for locking, the reset key is returned to its initial position if the pushing thereof is stopped.

Now, with reference to FIGS. 4 to 6, the following description is provided about in what state the movable contacts 9 and the fixed contacts 3 are each connected together.

First, an initial state is shown in FIG. 4. In this state, in each movable contact 9, the chip-like contact portion 9*c* and the protuberance 9*d* are held by the movable contact holding portion 5*d* of the associated slide member 5 in an obliquely inclined state with respect to the contact surface of each fixed contact 3.

Next, when the operating portion 5*a* of the slide member 5 is pushed, the protuberance 9*d* of the movable contact 9 first comes into contact with the individual contact 3*b* of the fixed contact 3. At this time, the circuit is OFF because the chip-like contact portion 9*c* of the movable contact 9 and the common contact 3*a* of the fixed contact 3 are spaced apart from each other (FIG. 5).

Further, when the operating portion 5*a* of the slide member 5 is pushed, the movable contact 9 swings and the chip-like contact portion 9*c* comes into contact with the common contact 3*a* because the hand-drum-like spring member 8 which urges the movable contact 9 is easy to bend with the hand-drum center as fulcrum, thereby turning ON the circuit (FIG. 6).

In this case, since the protuberance 9*d* of the movable contact 9 and the individual contact 3*b* of the fixed contact 3 are already in a contacted state, arcing takes place on the chip-like contact portion 9*c* side at the time of switching from one to the other contact. Therefore, a material having a high electrical durability such as a noble metal is used on only the chip-like contact portion 9*c*, whereby the protuberance 9*d* side can be made less expensive.

Moreover, since the movable contact 9 comes into sliding contact with the fixed contact 3 while swinging on the fixed contact at the time of switching from one to the other contact, there is obtained a self-cleaning effect and the contact reliability is improved thereby.

As set forth above, according to the structure of the switch device of the present invention, a connecting groove is formed in a housing having plural receptacle portions to connect the receptacle portions, plural fixed contacts and connecting terminals disposed in the plural receptacle portions are integrally fixed to a single wafer and are arranged side by side on one and same plane, and the wafer is engaged with the connecting groove formed in the housing, thereby allowing the plural fixed contacts to be disposed within the receptacle portions. With this structure, it is possible to gather the connecting terminals centrally and a single connector suffices for wiring the connecting terminals to a power supply and a ventilation fan. Consequently, the working efficiency at installation can be improved.

Moreover, the connecting groove in the housing is formed in a direction orthogonal to the ascending/descending direction of slide members, the fixed contacts on the wafer engaged with the connecting groove are disposed on the inside bottom of the receptacle portions so that their contact surfaces lie in a direction orthogonal to the ascending/descending direction of slide members, and the movable contacts and the fixed contacts are disposed in the ascending/descending direction of slide members. Therefore, contact portions come into sliding contact in the ascending/descending direction of the slide members, not requiring a certain distance for sliding contact in the slide member ascending/descending direction, whereby the depth of the housing can be made small and hence it becomes possible to reduce the switch size.

Further, the slide members are each formed with a holding portion for holding a movable contact and the movable contact is held by the holding portion in an obliquely inclined state with respect to a contact surface of a fixed contact. Therefore, when a contact portion or a protuberance of the movable contact comes into contact with the contact surface of the fixed contact, the contact is done in a state of sliding contact with the contact surface, whereby there is obtained a self-cleaning effect of the contact surface and the contact reliability of the contact portion is improved.

Further, the movable contact is formed with a convex protuberance on its side opposed to the contact surface of the fixed contact and is also formed with a chip-like contact portion, and when the slide member moves vertically, the protuberance first comes into abutment against the contact surface of the fixed contact and thereafter the contact portion thereof abuts the contact surface of the fixed contact. Consequently, an arc formed upon switching from one to another state is always applied to the chip-like contact portion, so that the protuberance which first comes into abutment against the fixed contact does not undergo a so large electrical load and is little deteriorated. Therefore, it is not necessary to use such an expensive chip-like contact portion as one formed by a noble metal and thus the cost of the switch contact portion can be reduced.

Further, a spring member which urges the movable contact in a direction of abutment against the contact surface of the fixed contact is provided in the holding portion of each of the slide members and it is formed by a hand-drum-like coiled spring. Therefore, even if spring member retaining portions located at both ends of the coiled spring tilt obliquely with respect to each other, a swing motion of the movable contact is facilitated to ensure a stable contact because the coiled spring is easy to bend with the hand-drum center thereof as fulcrum.

What is claimed is:

1. A switch device comprising:

a housing having a plurality of receptacle portions;

a plurality of fixed contacts disposed in the receptacle portions:

a plurality of slide members which hold movable contacts, the movable contacts movable into contact with and away from the fixed contacts, and which are disposed vertically movably in the receptacle portions; and a plurality of connecting terminals drawn out from the fixed contacts and projected to the exterior of the housing, wherein a connecting groove for connecting together the plural receptacle portions is formed in the housing, the plural fixed contacts and connecting the plurality of terminals are fixed integrally to a single wafer and are arranged on one and same plane, and the wafer is engaged with the connecting groove formed in the housing, thereby allowing the plural fixed contacts to be disposed within the receptacle portions.

2. A switch device according to claim 1, wherein the connecting groove formed in the housing is formed in a direction orthogonal to an ascending or descending direction of the slide members, the fixed contacts on the wafer engaged with the connecting groove are disposed on inside bottoms of the receptacle portions so that contact surfaces thereof lie in a direction orthogonal to the ascending or descending direction of the slide members, and the movable contacts and the fixed contacts are arranged in the ascending or descending direction of the slide members.

3. A switch device according to claim 2, wherein the slide members are each formed with a holding portion for holding an associated one of the moveable contacts, and the associated movable contact is held in the holding portion in an obliquely inclined state with respect to a contact surface of the associated one of the fixed contacts.

4. A switch device according to claim 3, wherein the movable contacts are each formed with a convex projection and a chip-like contact portion both on a surface thereof opposed to the contact surface of the associated fixed contact, and while the associated slide member moves vertically, the convex projection first comes into abutment against the contact surface of the associated fixed contact and thereafter the chip-like contact portion comes into abutment against the contact surface of the associated fixed contact.

5. A switch device according to claim 3, wherein a spring member for urging the associated movable contact in a direction of abutment against the contact surface of the associated fixed contact is provided in the holding portion of each of the slide members, the spring member being constituted by a hand-drum-shaped coiled spring.

* * * * *